US010029168B2

(12) United States Patent
Kapsalis et al.

(10) Patent No.: US 10,029,168 B2
(45) **Date of Patent: *Jul. 24, 2018**

(54) ENHANCED SAFETY DASHER BOARD ASSEMBLY

(75) Inventors: Marc Kapsalis, Elmhurst, IL (US); Bryan Brutlag, Lakeville, MN (US); Kevin Beauregard, Malibu, CA (US); Cory Crean, Northborough, MA (US); Carly Kristine Antonucci, Long Valley, NJ (US); Aren Yale Paster, Ballston Spa, NY (US); Mark Walter Steiner, Slingerlands, NY (US)

(73) Assignee: Marc Kapsalis, Elmhurst, IL (US)

( * ) Notice: Subject to any disclaimer, the term of this patent is extended or adjusted under 35 U.S.C. 154(b) by 1172 days.

This patent is subject to a terminal disclaimer.

(21) Appl. No.: 13/507,063

(22) Filed: May 31, 2012

(65) Prior Publication Data

US 2013/0040746 A1 Feb. 14, 2013

Related U.S. Application Data

(60) Provisional application No. 61/521,979, filed on Aug. 10, 2011.

(51) Int. Cl.

| | |
|---|---|
| ***A63C 19/00*** | (2006.01) |
| ***A63C 19/10*** | (2006.01) |
| *A63C 19/08* | (2006.01) |

(52) U.S. Cl.

CPC ..... *A63C 19/10* (2013.01); *A63C 2019/085* (2013.01)

(58) Field of Classification Search

CPC ..... A63C 19/10

(Continued)

(56) References Cited

U.S. PATENT DOCUMENTS

| | | | |
|---|---|---|---|
| 2,808,136 | A | 10/1957 | Hammitt et al. |
| 4,883,267 | A | 11/1989 | Burley |

(Continued)

FOREIGN PATENT DOCUMENTS

| | | | |
|---|---|---|---|
| CA | 2708199 | A1 | 1/2012 |
| CH | 645275 | A5 | 9/1984 |

OTHER PUBLICATIONS

Crystaplex brochure and description, Athletica, 2006, from www.sportssystemscorp.com.

(Continued)

*Primary Examiner* — Michael Dennis

(74) *Attorney, Agent, or Firm* — McDonnell Boehnen Hulbert & Berghoff LLP

(57) ABSTRACT

A dasher board assembly provides enhanced safety, such as for ice hockey rinks. The assembly is constructed so that on low height impacts a dampening material with at least one of a damping coefficient of about 1.7-3.2×$10^4$ N-s/m, a spring constant of about 1.5-3.0×$10^6$ N/m, and a loss coefficient greater than 0.15, absorbs the impact. On high height impacts both the dampening material and deflection of cantilevered generally vertical polygonal aluminum tubes absorb the impact. The assembly results in a Head Injury Criteria of less than 250 for all realistic scenarios, and a reduction of HIC values of at least 30% compared to an equivalent assembly with a rigid frame.

13 Claims, 9 Drawing Sheets

(58) Field of Classification Search
USPC ..... 472/94
See application file for complete search history.

(56) References Cited

U.S. PATENT DOCUMENTS

| | | | | |
|---|---|---|---|---|
| 4,927,134 | A | 5/1990 | Burley | |
| 5,953,882 | A | 9/1999 | Vallance et al. | |
| 6,004,217 | A | 12/1999 | Johnston et al. | |
| 6,004,218 | A | 12/1999 | Keating et al. | |
| 6,095,503 | A * | 8/2000 | Burley et al. | 256/24 |
| 6,106,401 | A | 8/2000 | McAlpine | |
| 6,155,022 | A | 12/2000 | DeCanio et al. | |
| 6,598,365 | B2 | 7/2003 | Abraham et al. | |
| D487,317 | S | 3/2004 | Guertin | |
| 7,914,385 | B2 | 3/2011 | Palumbo et al. | |
| 8,087,101 | B2 * | 1/2012 | Ferguson | 2/455 |
| 2007/0287548 | A1 | 12/2007 | Irving et al. | |
| 2009/0137329 | A1 * | 5/2009 | Palumbo et al. | 472/94 |
| 2010/0288987 | A1 | 11/2010 | Irving | |

OTHER PUBLICATIONS

Gymnasium Wall Padding, admitted prior art, from www.victorystore.com.
Ashby, Michael, Materials Selection in Mechanical Design, 4th ed. Elsevier, 2011, Loss coefficient—Modulus graph.

* cited by examiner

ENHANCED SAFETY DASHER BOARD ASSEMBLY

CROSS-REFERENCE TO RELATED APPLICATION

This application is related to U.S. Provisional Application Ser. No. 61/521,979 filed Aug. 10, 2011, the priority of which is claimed and the disclosure of which is incorporated by reference herein.

BACKGROUND AND SUMMARY OF THE INVENTION

Many areas for playing sports or engaging in recreational activities, such as ice hockey rinks, roller skating (including in-line hockey) rinks, indoor soccer fields, indoor football fields, short track (or other) speed skating rinks, and indoor handball fields, have an exterior perimeter defined by wall panels. These wall panels are often referred to as "dasher boards," particularly in ice and in-line hockey and short track speed skating rinks. If a participant within such an area contacts the dasher boards at high speed, with high energy, and/or in an awkward position, serious injuries can result including concussions and neck and spinal cord injuries.

A number of prior art patented and commercial proposals and systems have sought to reduce the number or extent of injuries as a result of high speed, high energy, and/or awkward human contact with dasher boards. For example as early as 1983 Swiss Patent 645,275 considered hockey player safety as one motivation in providing a rubber plate at the bottom of a mounting system for dasher boards. In 1988 the disclosure in U.S. Pat. Nos. 4,888,367 and 4,927,134 dealt primarily with hockey player safety in employing a mounting system at the base of dasher boards that allowed the boards to pivot against the adjustable bias of spring elements to absorb the force of high energy impacts of players against the boards. In the late 1990s as a precursor to the ATHLETICA commercial ice hockey rink dasher board assemblies U.S. Pat. No. 6,004,217 proposed a number of alternative systems for absorbing impact forces such as pivoting a dasher board with respect to a lower frame against spring pressure, or providing discrete widely spaced compressible coil springs between a dasher board and vertical frame elements spaced along the height of the dasher board. In 2007 the inventors of U.S. Pat. No. 7,914,385 proposed utilizing a viscoelastic acrylic foam tape for attaching a dasher board to vertical posts and horizontal stringers of a dasher board frame to provide some energy absorption. Research related to dasher board safety systems continues today, as shown by Canadian patent application 2,708,199 published Jan. 5, 2012.

While some of the above proposals and systems can significantly reduce the probability of injury to players or participants impacting dasher boards at medium or high portions of the dasher boards, impacts at lower portions of the dasher boards are much more problematic. Also many prior art systems cannot achieve the desired level of protection to prevent or minimize the severity of concussions when the impacts are at high speed and/or energy, concussions almost universally occurring if the Head Injury Criteria (HIC-14) is 250 or more. HIC is determined by the following formula:

$$HIC = \left\{(t_2 - t_1)\left[\frac{1}{t_2 - t_1}\int_{t_1}^{t_2} a(t)dt\right]^{2.5}\right\}\max$$

According to the present invention a dasher board assembly is provided having enhanced safety, especially for impacts at lower portions of the dasher board. The assembly according to the present invention reduces HIC (compared to a rigid dasher board frame assembly) by at least 30%, and typically by more than about 60%, at virtually all practical impact speeds and energy levels at substantially any portion of a dasher board. For example according to the assembly of the invention at a test (not with a human participant) speed of over 18 mph HIC was reduced by about 68% compared to a rigid dasher board frame system. In any case, according to the invention for virtually every realistic scenario HIC is less than 250, often less than 50.

According to one aspect of the present invention a dasher board assembly providing enhanced safety comprises a frame and a substantially rigid (e.g. HDPE, or the other exemplary materials mentioned in U.S. Pat. No. 7,914,385, or mandated by any regulatory body) dasher board operatively attached to the frame and having a top area and bottom area. The frame is constructed, and the dasher board is operatively attached to the frame, so that when the top area of the board is impacted the assembly will absorb the force of impact primarily in a first mode of absorption, and so that when the bottom area of the board is impacted the assembly will absorb the force of impact primarily in a second mode of absorption.

Desirably the first mode of absorption comprises deflection of the frame, and the second mode of absorption comprises compression of a dampening material. Also when the top area of the board is impacted the assembly will also absorb the force of impact in the second mode of absorption in addition to the first mode.

In a preferred manner this is accomplished in part by providing a dampening material of particular characteristics between the dasher board and frame. Particular parameters for evaluating effective operation of dampening material according to the invention are often not readily available. While "damping coefficient" and "spring constant" are good parameters for objectively determining the ability of some devices or materials to dissipate energy, they do not completely directly translate to other materials. For some materials, such as foam (like rebond or type 1850 foam), loss coefficient is a desirable parameter. Loss-coefficient (typically indicated by the Greek letter $\eta$) measures the degree to which a material dissipates vibrational energy.

Given the limitations of one or more parameters being definitive in quantitatively defining the ability of the dampening material according to the invention to effect proper damping so as to assure that HIC is always below 250, it is to be understood that the parameters set forth will not be exactly precise for all materials. However, even if they are not precisely correct they provide definitive enough information for one or ordinary skill in the art to properly select the particular features of a given material to be employed.

The dampening material desirably utilized according to the invention will be substantially continuous and have a damping coefficient of about $1.7\text{-}3.2\times10^4$ Newton seconds per meter and/or a spring constant of about $1.5\text{-}3.0\times10^6$ Newtons per meter. Where the dampening material is foam it desirably has a loss coefficient $\eta$ of more than 0.15.

The frame preferably comprises cantilevered vertical frame elements (e.g. rectangular aluminum tubes), and the first mode of absorption preferably comprises deflection of the cantilevered vertical frame elements.

As earlier indicated, the first and second modes operate so that an HIC value of less than 250, preferably even 50 or less, results from the impact of a human being against the dasher boards during all practical scenarios.

According to another aspect of the present invention there is provided a dasher board assembly comprising: A frame including a plurality of substantially vertical frame elements and a plurality of substantially horizontal frame elements; at least one substantially rigid dasher board operatively connected to the vertical and horizontal frame elements; a dampening material operatively provided between the dasher board and the frame elements, the dampening material having a plurality of openings therein; a plurality of fasteners operatively connected to the board substantially in alignment with the openings, and passing therethrough; and a plurality of openings in the frame elements substantially in alignment with the dampening material openings, the fasteners passing therethrough so as to be movable with respect to the frame elements.

The dasher board has upper and lower areas; and desirably the substantially vertical frame elements are mounted and constructed (e.g. cantilevered aluminum elements, such as AL 6061 T6 rectangular hollow tube extrusions) so that they flex when the upper area is impacted by a human being. Desirably the assembly defines a sporting or recreational area selected from the group consisting essentially of ice and in-line hockey rinks, roller skating rinks, indoor soccer fields, indoor football fields, speed skating rinks, and indoor handball fields.

According to another aspect of the present invention there is provided a dasher board assembly comprising: A frame including a plurality of substantially vertical frame elements and a plurality of substantially horizontal frame elements; at least one substantially rigid dasher board operatively connected to the vertical and horizontal frame elements; and a dampening material operatively provided between the dasher board and at least most of the frame elements, the dampening material having a damping coefficient of about $1.7\text{-}3.2\times10^4$ N-s/m, and a spring constant of about $1.5\text{-}3.0\times10^6$ N/m. For example the dampening material may have a damping coefficient of about $2.7\times10^4$ N-s/m, and a spring constant of about $2.4\times10^6$ N/m, or both may have a value of about 2.

The dampening material may be foam with a $\eta$ value of 0.15 or more. One particular foam that may be utilized is rebond foam about 2.5-4 inches thick. Seven pound per cubic foot density rebond foam is particularly desirable, such as is used conventionally in 1.5 or 2 inch thickness for gymnasium wall padding. Alternatively foam type 1850 about 2.5-4 inches thick may be utilized. In any case the thickness must be such that the foam will not "bottom out" when it is compressed by the maximum practical impact force, but any thickness more than that is wasted.

The thickness of the foam may vary over the height of the frame, for example having a different thickness near the bottom than near the top, or the same thickness with a different damping coefficient and/or spring constant and/or $\eta$ value near the bottom.

According to yet another aspect of the present invention there is provided a dasher board assembly which comprises the following elements: A frame including a plurality of substantially vertical frame elements having top and bottom areas, and a plurality of substantially horizontal frame elements. At least one substantially rigid dasher board operatively connected to the substantially vertical and horizontal frame elements. The substantially vertical frame elements comprise cantilevers constructed and positioned so that upon an impact force at the top area at least one of the vertical frame elements will deflect a maximum of about two-four inches to dampen the force of the impact. The substantially vertical frame elements preferably comprise cantilevered aluminum tubes that are polygonal in cross-section, such as AL 6061 T6 rectangular hollow tube extrusions.

The dasher board assembly according to the invention has an HIC-14 value at least 30% less, desirably about 60% less, than a comparable assembly wherein the frame is rigid (e.g. wood, rigid metal, or a combination thereof). In any case the HIC value will be less than 250 for all practical scenarios.

It is the primary object of the present invention to provide a dasher board system with enhanced safety for participants within an area encompassed by the dasher boards. This and other objects of the invention will become clear from the detailed description of the invention, and from the appended claims.

DETAILED DESCRIPTION OF THE DRAWINGS

Figure 1:
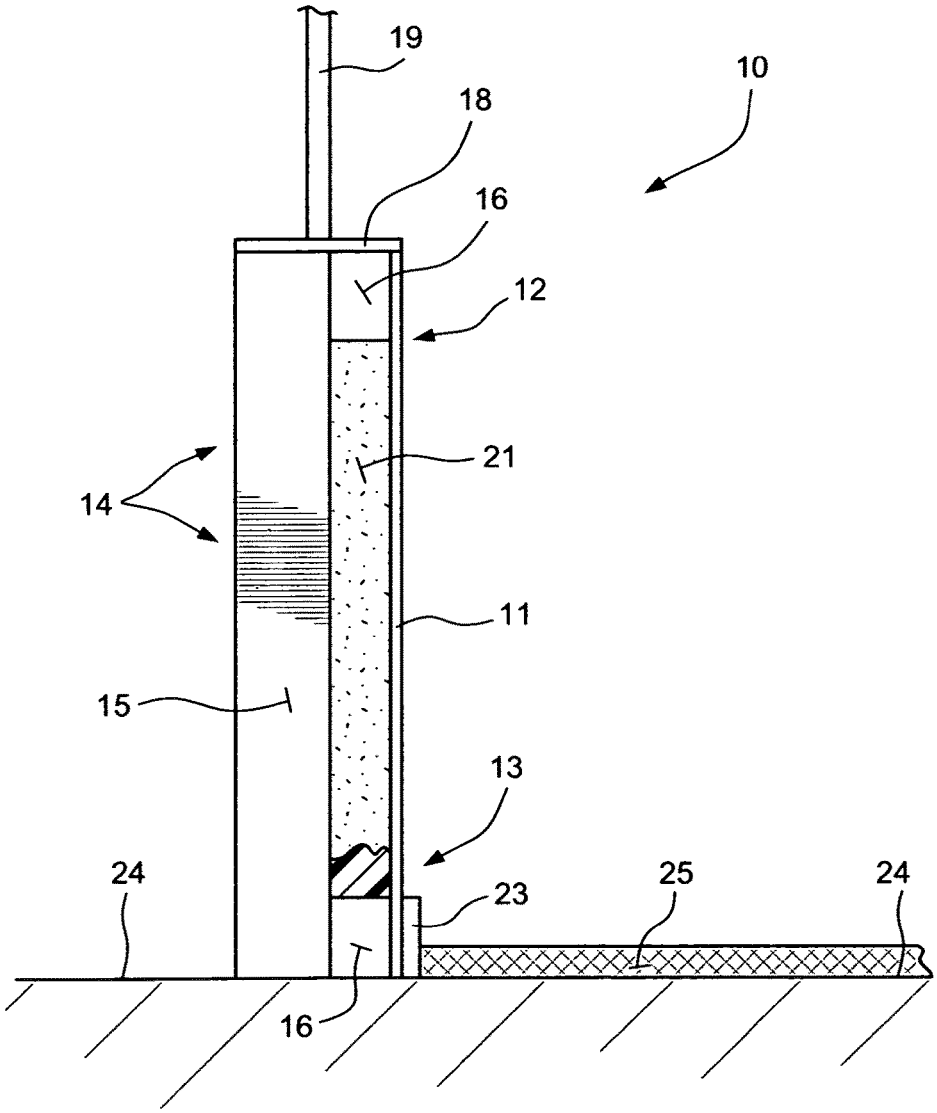
FIG. 1 is schematic side view, mostly in elevation and partly in cross-section, of an exemplary dasher board assembly according to the present invention.

The exemplary dasher board assembly 10 in FIG. 1, and in all other embodiments of the invention, utilizes conventional dasher boards 11. The dasher boards 11 may be made of any conventional or hereafter developed material, such as the materials described for "facing panels" in column 5 of U.S. Pat. No. 7,914,385 including, but not limited to, HDPE, thermoplastic elastomer polyolefin, fiberglass, plywood, or other substantially rigid (compared to the dampening material to be hereinafter described) material. The dasher boards 11 may be of any suitable size (length, width and thickness) and are typically substantially planar, although they can be curved (or flexed into a curved shape) for corners of the rink, playing field, or recreational area that they define at least part of the perimeter of.

The boards 11 have a top area or portion 12 and a bottom area or portion 13, and are disposed substantially vertically during use.

The assembly 10 also includes a frame, shown generally by reference numeral 14 in FIG. 1, to which the boards 11 are operatively attached. The frame 14 typically includes a plurality of substantially vertical frame elements 15 (only one of which is shown in the side view of FIG. 1) and one or more substantially horizontal frame elements 16. Although not significant for the distinctions of the invention over the prior art, the frame 14 also typically includes a conventional top bumper 18 and has conventional components (not shown) for mounting one or more transparent upper shielding panes 19 of any suitable conventional material such as tempered glass, acrylic, or Plexiglas.

One feature according to the invention is the provision of a dampening material, shown schematically at 21 in FIG. 1, between at least some, and preferably all, of the frame elements 15, 16 and the dasher board 11. The dampening material 21 must have very significant impact energy absorbing characteristics, much more significant (e.g. at least three times greater) than provided by an acrylic foam tape substrate. The material 21 desirably has a damping coefficient of about 1.7-3.2 [e.g. about 2.7]$\times 10^4$ N-s/m, and/or a spring constant of about 1.5-3.0 [e.g. about 2.4]$\times 10^6$ N/m. Two examples of materials that may provide that function are rebond foam having a thickness of about 2.5-4 inches, and type 1850 foam having a thickness of about 2.5-4 inches, both with a loss coefficient $\eta$ of more than 0.15 (e.g. >0.25). Other examples of suitable dampening material 21 include solid sheets or blocks of natural or synthetic rubber, perforated sheets or blocks of rubber, layers of DEFLEXION substrates from Dow Corning Corporation, compressible resilient lattices, or composites of a number of the above materials with or without foam.

While FIG. 1 shows the dampening material 21 of substantially constant thickness throughout, it may have different thicknesses in different areas. For example material 21 could have a slightly different thickness near the bottom area 13 of the board 11 than at the top area 12. Alternatively a dampening material 21 with different spring constant and/or damping coefficient and/or $\eta$ value could be provided at or near the bottom area 13 than at or near the top area 12. Alternatively a composite of two materials (e.g. foam and rubber) could be provided at one area 12, 13, and a unitary material (e.g. just foam) at the other area 12, 13.

According to the invention it is highly desirable to provide the dampening material 21 substantially continuously (although not necessarily completely, i.e. covering at least about 75-95%) between the frame 14 and dasher board 11 rather than at widely spaced discrete locations. Also it is desirable that the material 21 comprise a compressible material, rather than mechanical elements such as coil springs. A substantially continuous material has the advantages of ease of construction and use, longevity, precise functionality at all locations, and others.

The assembly 10 may have any other desirable conventional components, such as an ice dam (not shown) if the assembly defines the perimeter of an ice hockey or short track speed skating rink, kickplate 23, and bolts and/or other hardware (not shown) for mounting at least the substantially vertical frame elements 15 to a floor 24 or ground surface on the opposite side of the dasher board 11 from the ice 25 or other playing or recreational surface.

Figure 2:
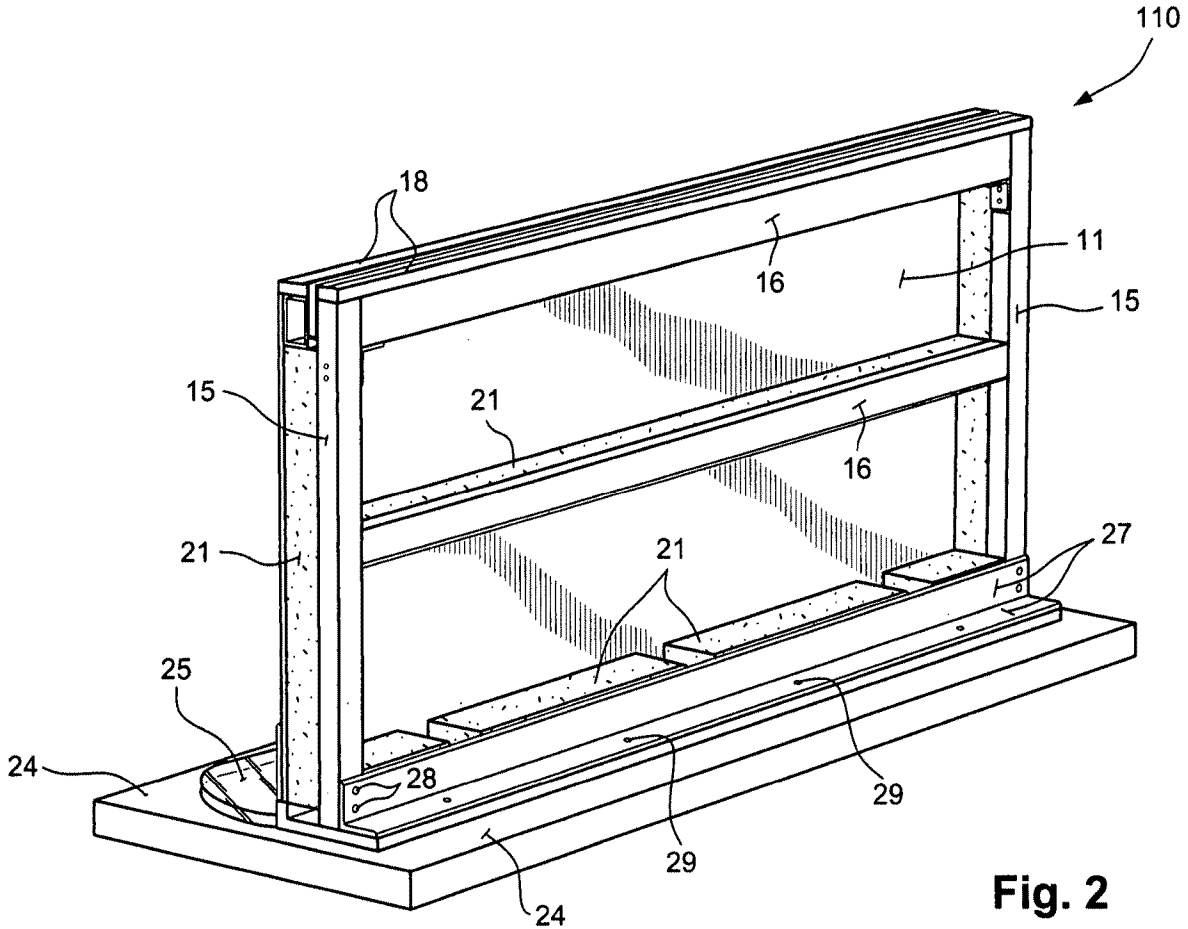
FIG. 2 is a more detailed rear isometric view of one section of an exemplary dasher board assembly according to the present invention with the transparent shielding panel removed.

FIG. 2 shows, from the rear, a more detailed assembly 110 according to the invention, reference numerals in this embodiment being the same for comparable components in the FIG. 1 embodiment. The assembly 110 is just one section, having at least one dasher board 11, which section will be connected together with other like sections in a conventional manner (or as described with respect to FIG. 10) to define a perimeter of a rink, playing field, or recreational area. The assembly 110 has upper and middle substantially horizontal frame elements 16, two substantially vertical frame elements 15 at opposite sides thereof, and dampening material (e.g. foam) 21 substantially continuously along the lengths of the frame elements 15, 16.

The assembly 110 also includes a desirable combination bottom frame and mounting element in the form of an angle iron or other unitary L-shaped element 27. Element 27 is connected by screws—shown schematically at 28 in FIG. 2—or other mechanical fasteners [or by permanent fixing structures in a permanent facility] to the bottom portions of the frame elements 15, and by other mechanical fasteners 29 to the floor 24. This embodiment also shows a particular configuration of an ice dam 31 which additionally forms a base for the elements 15, 27 and through which the fasteners 29 pass to connect the assembly 110 to the floor 24. Element 27 may be of any suitable rigid material, such as steel or aluminum.

While dimensions of the components may vary, in a conventional situation where the boards 11 have a height of about forty inches (for a conventional ice hockey rink) the legs of the L-shaped element 27 will have widths of about three-five (e.g. about four) inches, and a thickness of about 0.4-0.6 (e.g. about 0.5) inches.

While the frame elements 15 may have a wide variety of configurations, such as spring steel planar or curved plates, bars, or tubes, in the preferred embodiment the elements 15 comprise polygonal (preferably quadrate) cross-section aluminum tubes. Since tubes 15 are polygonal in cross-section there will be a substantially flat surface which the dampening material 21 abuts, and the cantilever mounting thereof will result in the ability of the elements 15 to deflect when the upper area 12 of the board 11 is impacted, to absorb energy.

One particularly desirable material for the elements 15 comprises AL 6061 T6 rectangular hollow tube extrusions. This material will provide approximately a two-four (e.g. about three) inch deflection when the topmost area 12 of the board 11 receives a maximum probable impact, absorbing the majority of the energy of the impact, while the dampening material (e.g. foam) 21 also absorbs some energy.

That is, the vertical supports 15 act as a pair of cantilever beams.

Figure 3:
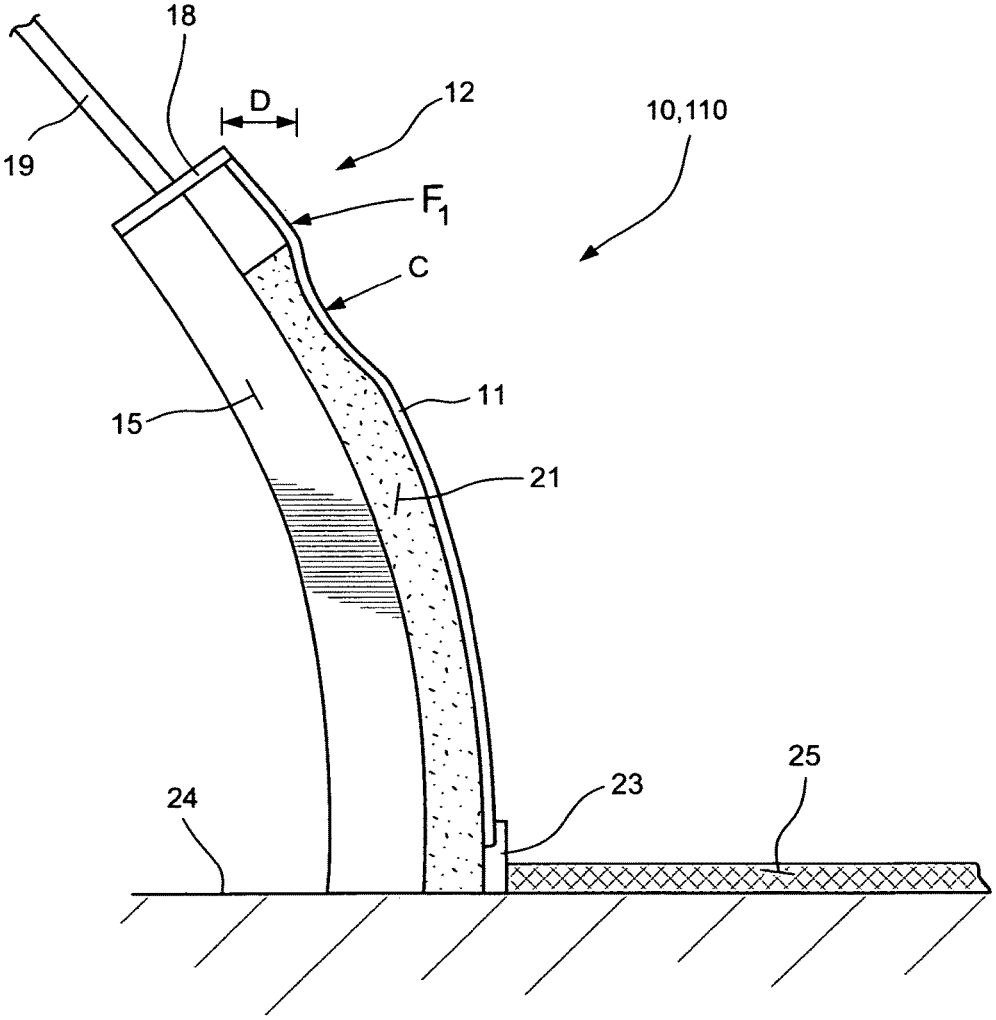
FIG. 3 is a side schematic view of the assembly of FIG. 1 showing, in exaggerated form, the deflection of the cantilevered substantially vertical frame elements and compression of the dampening material when the illustrated dasher board is subjected to an impact force $F_1$ near the top thereof.
Figure 4:
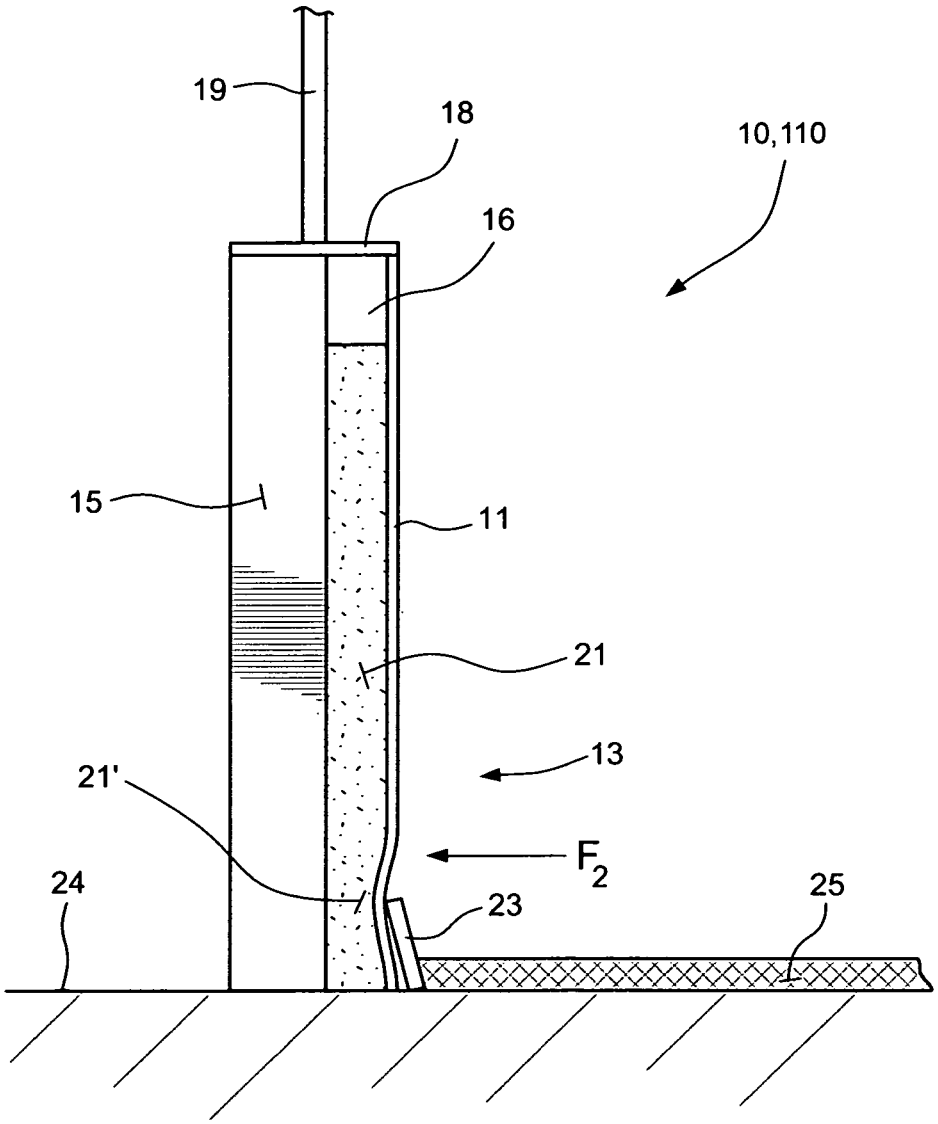
FIG. 4 is a view identical to that of FIG. 3 showing compression of the dampening material when the dasher board is subjected to an impact force $F_2$ near the bottom thereof.

FIGS. 3 and 4, in a schematic and exaggerated manner for demonstrative purposes, illustrate the functionality of an assembly 10, 110 according to the invention when subjected to large forces, such as professional ice hockey players impacting the board 11 at speeds up to 30 mph.

FIG. 3 illustrates the situation wherein the impact force $F_1$ is at or near the upper area 12 of the board 11 (assumed to have a conventional height of about forty inches). The force $F_1$ is absorbed primarily in a first mode of absorption, namely by the deflection of one or more of the vertical frame elements 15, the deflection D being about three inches. Also, some compression of the dampening material (e.g. foam) 21 may or will also take place, as indicated by C in FIG. 3, providing a second mode of absorption and thus absorbing some of the energy of the force $F_1$.

As seen in FIG. 4 where the force $F_2$ is applied at the bottom area 13 of the board 11 the force will be absorbed primarily (or essentially exclusively) by the second mode, namely the compression of the dampening material (e.g. foam) 21. This is schematically illustrated in FIG. 4 by the compressed portion 21' of the dampening material 21.

The assemblies 10, 110 function to assure an HIC of less than 250 (and often less than 50) for all practical scenarios that would be encountered in an ice hockey game or other activity. The assemblies 10, 110 reduce the HIC by at least 30% compared to dasher board assemblies with rigid frames, and typically by more than about 60%.

Figure 5:
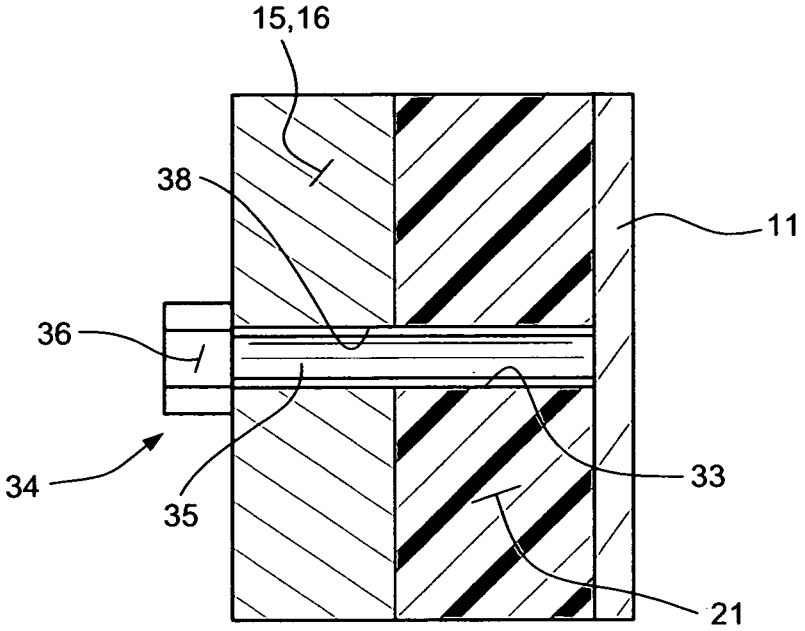
FIG. 5 is a schematic detailed cross-sectional view, with one element in elevation, of the dasher board assembly of FIG. 1 in its normal configuration at a location where a mechanical fastener connects the dasher board to a frame element.
Figure 6:
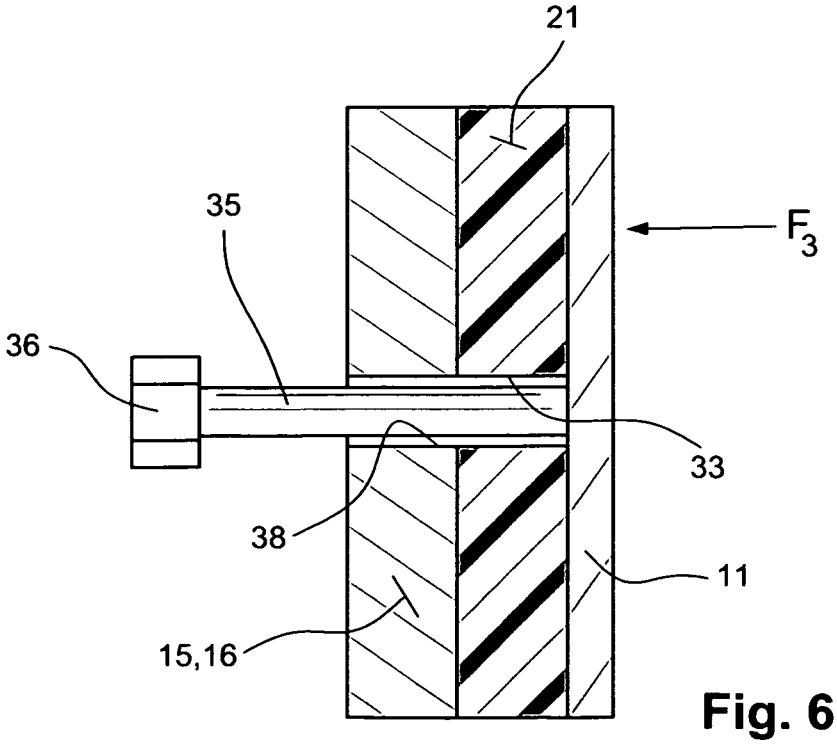
FIG. 6 is a view identical to that of FIG. 5 when an impact force $F_3$ causes compression of the dampening material.

While the board 11 may be operatively connected to the material 21 and frame elements 15, 16 by any suitable conventional or hereafter developed mechanism, FIGS. 5 and 6 show one desirable manner of connection, which also accommodates compression of the dampening material 21 and provides proper alignment of the components even during compression. In the FIGS. 5 & 6 embodiment, the dampening material 21 has a plurality (only one of which is shown in the FIGURES, but which are provided wherever desirable at all portions of material 21) of openings 33 therein. A plurality of fasteners 34 are operatively connected to the dasher board 11 substantially in alignment with the openings 33, and passing therethrough. In the embodiment illustrated each fastener has a shaft 35 and a head 36. The shaft 35 may be connected by a recessed (in board 11) screw fastener, adhesive, ultrasonic welding, or any other suitable technique, to the board 11. The head 36 may be removable for ease of disassembly. For example the head 36 may be a nut and the cooperating end of shaft 35 screw-threaded.

As also shown in FIGS. 5 & 6 there are provided a plurality of openings 38 in the frame elements 15, 16 substantially in alignment with said dampening material openings 33, the fastener shafts 35 passing therethrough so as to be movable with respect to the frame elements 15, 16. FIG. 5 shows the components during normal conditions, and FIG. 6 shows the same components when a large impact force $F_3$ is applied thereto, the energy from the impact force absorbed by compression of the material 21. The material 21 returns to the FIG. 5 configuration as soon as the force $F_3$ is removed.

While the fasteners 34 and cooperating openings 33, 38 are preferred, the material can be operatively connected to one or both of the board 11 and frame elements 15, 16 by other suitable mechanisms, such as adhesive, ultrasonic welding, adhesive augmented laser or ultrasonic welding, or the like, as long as substantially free compression of the material 21 is provided at the same time that the elements 11, 15, 16 are operatively connected together.

Figure 7:
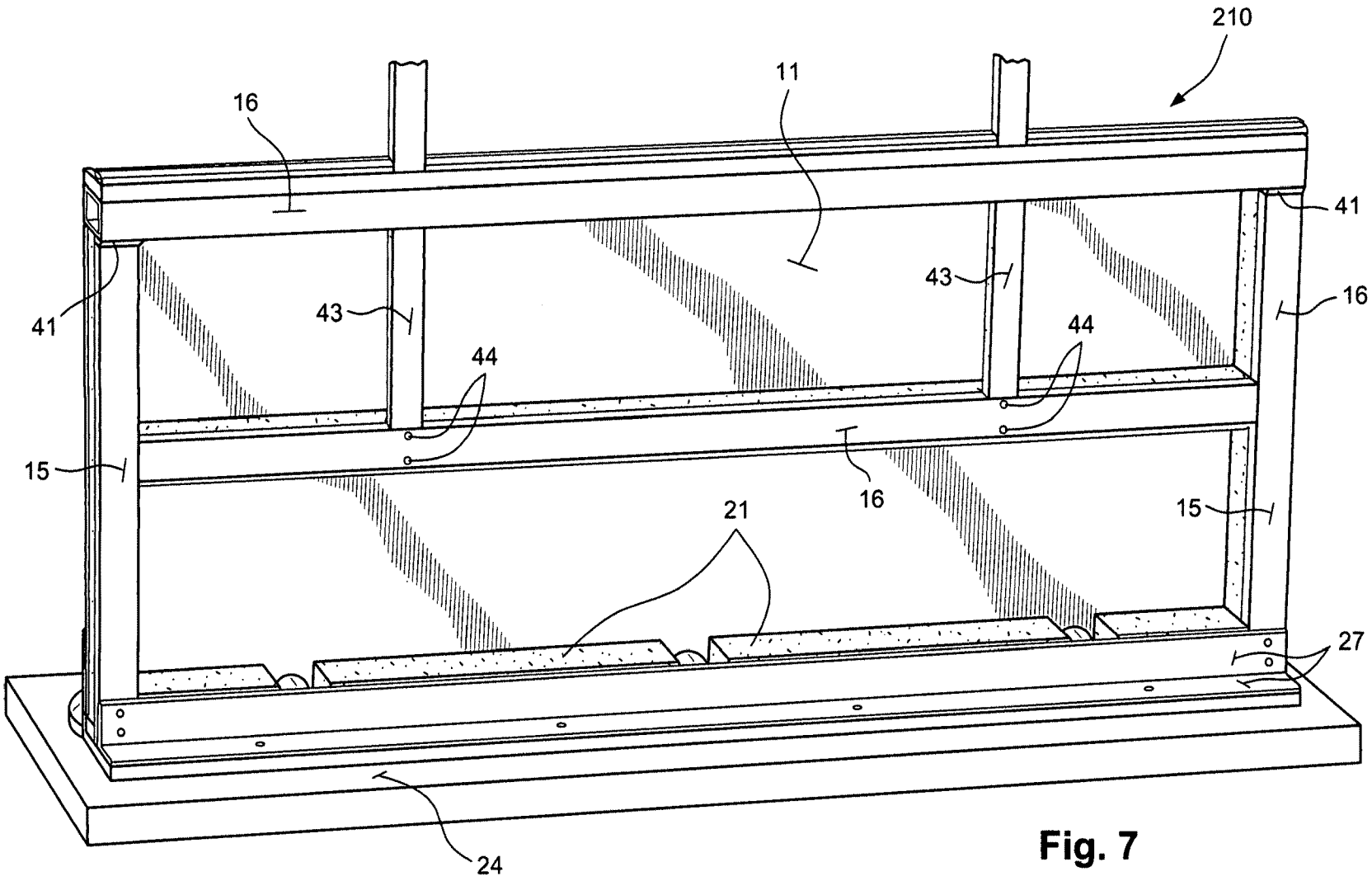
FIG. 7 is a primarily rear, slightly isometric, view of another exemplary embodiment of a dasher board frame assembly according to the invention.

FIG. 7 shows a slightly different embodiment of the assembly according to the invention, illustrated generically by reference numeral 210; components thereof the same as in the FIGS. 1 and 2 embodiments are shown by the same reference numerals.

The primary differences between the FIGS. 2 and 7 embodiments are the provision in FIG. 7 of fillet welds 41 where the side substantially vertical frame elements 15 are connected to the top substantially horizontal frame element 16 which overlies the tops of the elements 15, and the provision of two or more substantially vertical H-beam posts 43 that extend from the middle substantially horizontal frame element 16 up past the top element 16. The posts 43 hold the conventional transparent shielding panels (19 in FIG. 1) in place.

The posts 43 may be of aluminum, and connected by fasteners, shown schematically at 44 in FIG. 7, to the middle element 16. The fillet welds 41 may be provided at the back edge, inside edge, and front edge of the elements 15. In both the FIGS. 2 and 7 embodiments fillet welds (not referenced) may connect the middle frame element 16 to the side frame elements 15.

Figure 8:
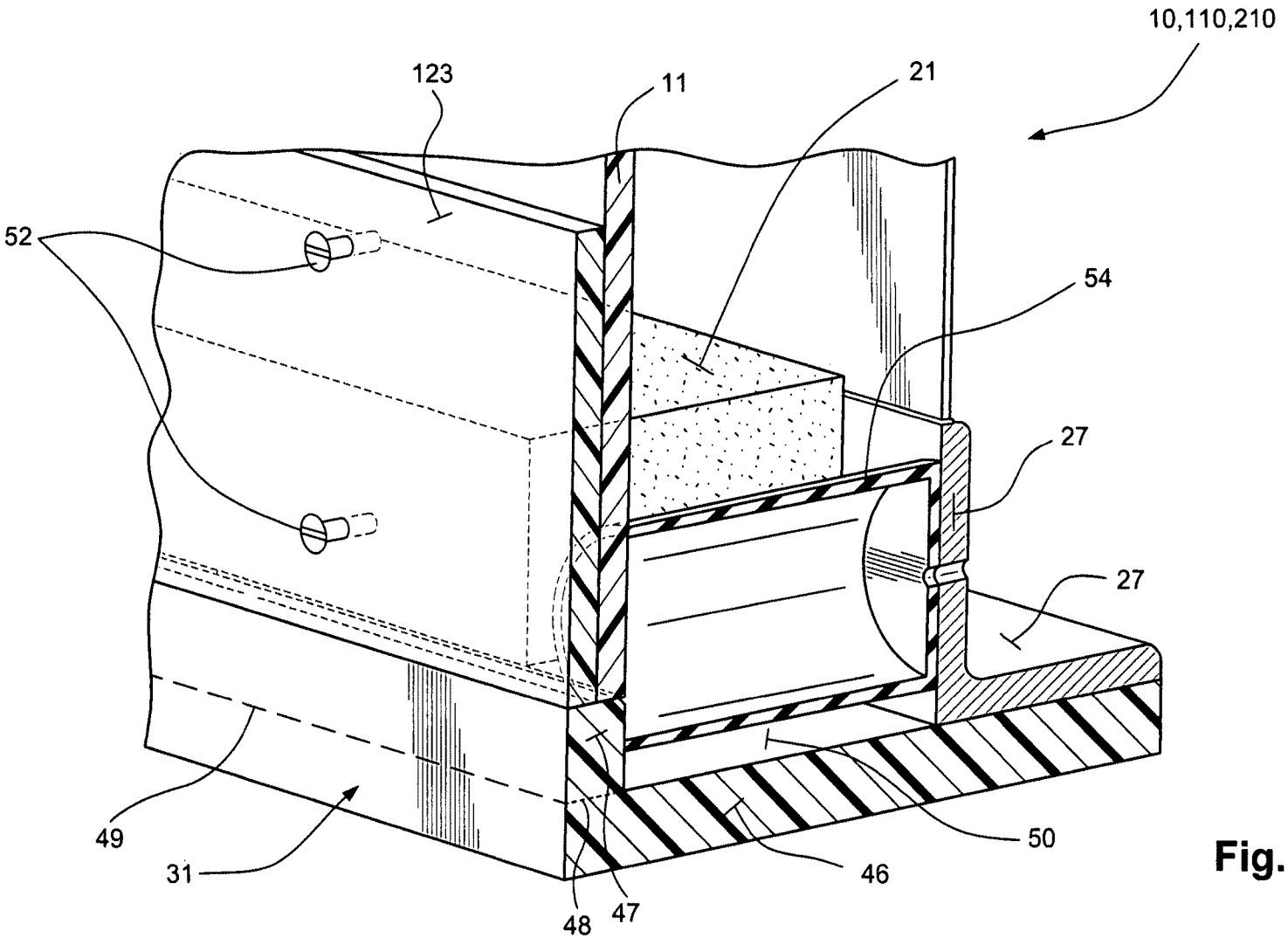
FIG. 8 is a detailed perspective view, with most components shown in cross-section, of exemplary ice dam, kick-plate, anchoring, and buckling stopper elements that may be utilized with a dasher board assembly according to the present invention.

While not part of the present claimed invention, especially when the assemblies 10, 110, 210 are to be used for ice hockey rinks it is highly desirable to provide other advantageous components to facilitate that use. A highly desirable ice dam, kickplate, and buckling stopper that may be utilized with the assemblies according to the invention are illustrated in FIG. 8. FIG. 8 shows in more detail the ice dam 31 (also called an "ice retainer") somewhat visible in FIG. 2. The ice dam 31 is particularly constructed to properly keep water and ice inside a hockey or speed skating rink and help prevent leakage and ice buildup beyond the dasher board 11. Conventionally an ice dam is usually an HDPE or steel rectangular block located between the concrete floor 24 and an anchoring structure for the dasher board frame. However using such conventional structures a significant layer of ice can develop inside the boards 11, mostly from freezing condensate. The ice dam 31 minimizes this problem.

The advantageous ice dam 31 of FIG. 8 has two components, a main body component 46, and a lip 47. A dotted line 48 is illustrated in FIG. 8 just to show the interface between the component 46 and lip 47, but in this preferred embodiment the elements 46, 47 are a unitary piece of material, such as HDPE. However a dotted or solid line 49 (preferably an extension of the interface-illustrating line 48) or other indicia may be printed, painted, etched, or otherwise provided on the portion of the dam 31 in contact with ice to indicate the maximum level to which the rink should be filled.

The lip 47 extends a significant distance above the top of the body component 46, as clearly seen in FIG. 8. The "significant distance" is typically between about ½-two ½ inches, most desirably about one inch. In addition to keeping the water/ice inside the rink so that it cannot move past board 11, the lip 47 also creates a sacrificial open space 50 beneath the dampening material 21 which allows any ice that may buildup due to condensation to have no effect on the functionality of the damping and energy absorbing functions of the material 21. The lip 47 also facilitates proper rebound of a puck from the assembly 10, 110, 210 since it provides rebound characteristics comparable to existing commercial ice hockey rinks.

FIG. 8 also shows a kickplate 123 that performs the same function as the kickplate schematically illustrated at 23 in FIG. 1 and conventional kickplates. The kickplate 123, like conventional kickplates, provides protection from skates and pucks hitting the side of the rink and it must exhibit the properties of high impact strength, abrasion-resistance, low coefficient of friction, moisture, stain and abrasion-resistance, and durability. The kickplate 123 may be made of high quality HDPE with UV stabilizers. As is conventional the kickplate 123 may be connected to the dasher board 11 by a plurality of screws (e.g. with recessed heads) 52 or other mechanical fasteners.

Because of the provision of the dampening material 21, the kickplate 123 may not exhibit the desired puck rebound characteristics for high level hockey. It is highly desirable for a puck to rebound from the kickplate 123 with a velocity at least 30-40% as high as its impact velocity. In order to facilitate this the structure of FIG. 8 includes a plurality (only one of which is shown for clarity of illustration) of puck rebound facilitating structures 54 spaced at intervals along the length of the kickplate 23 and operatively disposed between the kickplate 123 and the upward leg of the angle iron 27. The dampening material 21 is provided between structures 54.

The puck rebound facilitating structure 54 may comprise any device which has the dual functions of high energy absorption upon a relatively low speed and high mass impact (such as a hockey player or his/her equipment impacting a board 11 and/or kickplate 123) and minimal energy absorption upon impact of the kickplate 123 by a high speed low mass object (such as a puck). For example the structure 54 should act generally similarly to the foam 21 if a 175 pound hockey player travelling at 10 mph impacts the board 11 and/or kickplate 123, yet if a six ounce puck travelling at 100 mph impacts the kickplate 123 the structure 54 must act essentially like a rigid member and provide a rebound speed of at least 30-40 mph.

While any device having the functionality set forth above may be utilized the preferred embodiment of the puck rebound facilitating structure 54 in FIG. 8 is a buckling elastomeric material tube. While a wide variety of materials may be utilized, one particularly desirable material comprises silicone butadiene rubber (SBR), selected for its modulus of elasticity, good flexural characteristics at low temperature, and low cost. In one embodiment the SBR tube has a tube wall 55 about 0.17-0.25 inches thick (e.g. about 0.1875 inches), and an outer diameter 56 of about two ½ to three ½ inches (e.g. about three inches).

Utilizing the structure 54 when a hockey player impacts the board 11 and kickplate 123 the tube 54 buckles and has energy absorption characteristics generally comparable to those of the material 21. However when a puck at a high rate of speed impacts the kickplate 123 the structure 54 provides a more or less rigid backstop, causing the puck to rebound at at least about 30-40% of its impact velocity whereas if the structure 54 were not present it might rebound with less than 10% of its impact velocity.

Figure 9:
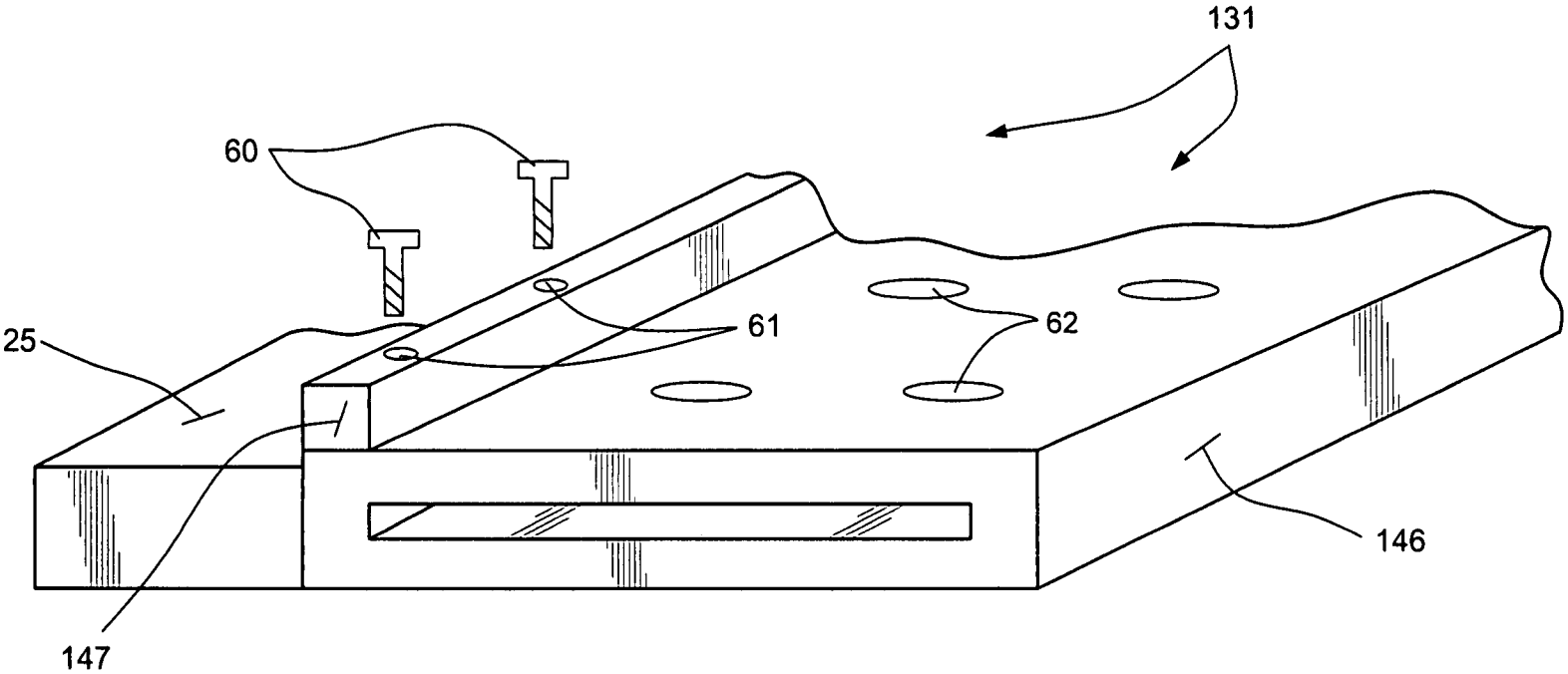
FIG. 9 is a schematic perspective view of an alternative configuration of ice dam to that illustrated in FIG. 8.

FIG. 9 shows an ice dam 131 with an alternative construction to that of the ice dam 31 of FIG. 8 with comparable elements shown by the same reference numeral only preceded by a "1." The ice dam 131 has the potential advantages of adjustability of ice thickness and material variety, while still providing the functionality of the beneficial ice dam 31.

The ice dam 131 has two distinct parts, a body component 146 and a lip 147, rather than being a unitary structure like the ice dam 31. The component 146 may be of any suitable material, such as a rectangular cross-section steel tube as illustrated in FIG. 9. Lips 147 of adjustable heights, depending upon the thickness of ice desired for a rink, may be provided, a lip 147 being connectable by a plurality of mechanical (e.g. screw) fasteners 60 to the component 146. The fasteners 60 may pass through openings 61 in lip 147 and screw into conventional threaded openings (not shown) in the body component 146. Other mechanical fasteners (not shown) may pass through openings 62 in body 146 to attach it to a floor (24).

Figure 10:
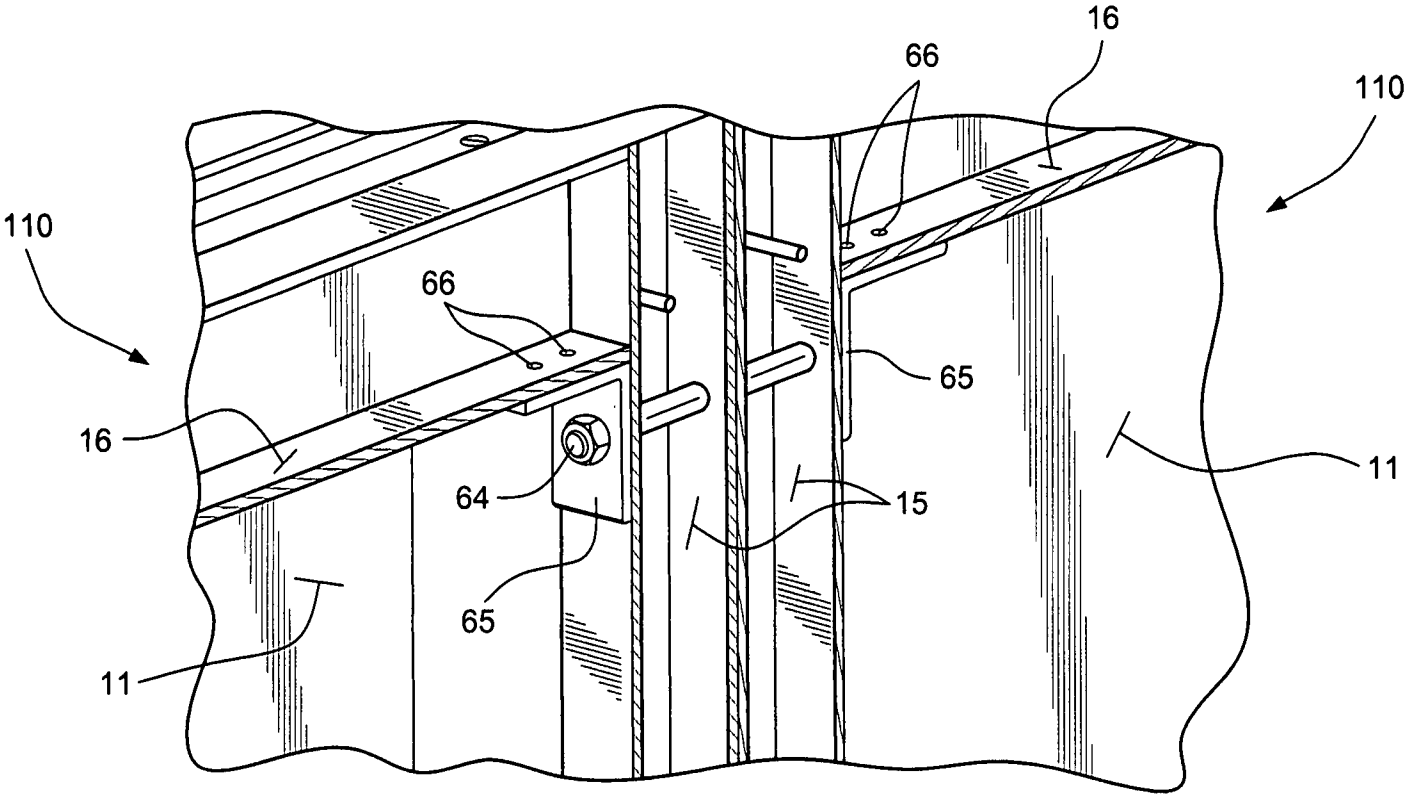
FIG. 10 is a schematic perspepctive view, partly in cross-section, of an exemplary manner of connecting together adjacent dasher board assemblies according to the invention.

FIG. 10 illustrates one possible connection of adjacent dasher board assemblies 10, 110, 210 together. Conventionally dasher board assemblies are connected together at about the middle (vertically) of the boards. When cantilevered substantially vertical frame elements 15 according to the invention are utilized, however, it is desirable to fasten the adjacent board assemblies 10, 110, 210 together near the top, so that proper energy absorption will occur (to assure alignment of the adjacent panels at the most significant location of cantilever action during a large impact).

In the exemplary embodiment of FIG. 10 a single bolt (e.g. ½ inch stainless steel) 64 passes through substantially vertical tubular frame elements 15 (shown in cross-section) on adjacent assemblies 110. Optionally L-brackets 65 may be provided. When brackets 65 are used the bolt 64 passes through one leg of each L-bracket 65 while the other leg is connected (e.g. by screws 66) to a substantially horizontal frame element 16. Conventional gussets (not shown) may be used instead of brackets 65.

All narrow ranges within a broad numerical range set forth above are also specifically included herein. For example a range of about two-four inches includes 1.95-3.22 inches, 2.81-4.04 inches, and all other narrow ranges within the broad range.

While the invention has been shown and described in what is presently conceived to be the preferred embodiment thereof it is to be understood that many modifications are possible within the scope of the invention. Therefore the invention is to be accorded the broadest interpretation possible, limited only by the prior art, so as to encompass all equivalent structures and devices.

What is claimed is:

1. A dasher board assembly providing enhanced safety, comprising:

a frame and at least one substantially rigid dasher board operatively attached to said frame and having a top area and bottom area;

said frame constructed, and said dasher board operatively attached to said frame, so that when said top area of said board is impacted said assembly will absorb the force of impact primarily in a first mode of absorption, and so that when said bottom area of said board is impacted said assembly will absorb the force of impact primarily in a second mode of absorption, wherein said frame comprises cantilevered substantially vertical frame elements, wherein said first mode of absorption comprises deflection of said cantilevered substantially vertical frame elements, and wherein said cantilevered substantially vertical frame elements comprise polygonal cross-section aluminum tubes.

2. A dasher board assembly as recited in claim 1 wherein dampening material is substantially continuously provided between said dasher board and said frame; and wherein said first mode of absorption comprises deflection of said frame, and wherein said second mode of absorption comprises compression of said dampening material.

3. A dasher board assembly as recited in claim 1 wherein said first and second modes operate so that a Head Injury Criteria value of less than 250 results from the impact of a human being against said dasher board.

4. A dasher board assembly as recited in claim 1 wherein when said top area of said board is impacted said assembly will also absorb the force of impact in said second mode of absorption in addition to said first mode.

5. An assembly as recited in claim 2 wherein when said top area of said board element is impacted said assembly will also absorb the force of impact in said second mode of absorption in addition to said first mode, and wherein said dampening material has at least one of a damping coefficient of about $1.7\text{-}3.2\times10^4$ N-s/m, a spring constant of about $1.5\text{-}3.0\times10^6$ N/m, and an $\eta$ value >0.15.

6. An assembly as recited in claim 2 wherein said dampening material is selected from the group consisting essentially of rebond foam having a thickness of about 2.5-4 inches and type 1850 foam having a thickness of about 2.5-4 inches, and an $\eta$ value >0.15.

7. An assembly as recited in claim 1 wherein said assembly defines a sporting or recreational area selected from the group consisting essentially of ice and in-line hockey rinks, roller skating rinks, indoor soccer fields, indoor football fields, speed skating rinks, and indoor handball fields.

8. An assembly as recited in claim 1 wherein dampening material is provided substantially continuously between said dasher board and said frame elements, and wherein said dampening material has at least one of a damping coefficient of about 2-2.7×$10^4$N-s/m, a spring constant of about 2-2.4×$10^6$ N/m, and an $\eta$ value >0.15.

9. A dasher board assembly comprising:

a frame including a plurality of substantially vertical frame elements and a plurality of substantially horizontal frame elements;

at least one substantially rigid dasher board operatively connected to said substantially vertical and horizontal frame elements; and a dampening material operatively provided between said dasher board and a plurality of said vertical and horizontal frame elements, said dampening material having at least one of a damping coefficient between about 1.7×$10^4$ N-s/m and about 3.2×$10^4$ N-s/m, a spring constant between about 1.5×$10^6$ N/m and about [H]3.0×$10^6$ N/m, and an $\eta$ value >0.15.

10. An assembly as recited in claim 9 wherein said dampening material has a damping coefficient of about 2.4×$10^4$N-s/m, and a spring constant of about 2.7×$10^6$ N/m.

11. An assembly as recited in claim 9 wherein said assembly reduces HIC-14 values by at least 30% compared to a like assembly wherein the frame is of rigid and wherein said substantially vertical frame elements comprise cantilevered aluminum tubes that are polygonal in cross-section.

12. An assembly as recited in claim 9 wherein said dampening material comprises foam about 2.5 inches or more thick and having a loss coefficient greater than 0.15.

13. A dasher board assembly comprising:

a frame including a plurality of substantially vertical frame elements having top and bottom areas, and a plurality of substantially horizontal frame elements;

at least one substantially rigid dasher board operatively connected to said substantially vertical and horizontal frame elements; and wherein said substantially vertical frame elements comprise cantilevers constructed and positioned so that upon an impact force at said top area of said frame elements said vertical frame elements will deflect a maximum of about two-four inches to dampen the force of the impact, and wherein said substantially vertical frame elements comprise cantilevered aluminum tubes polygonal in cross-section, and wherein said assembly reduces HIC-14 values by at least 30% compared to a like assembly wherein the frame is of rigid.

* * * * *